US008657634B2

(12) United States Patent
Bootle et al.

(10) Patent No.: US 8,657,634 B2
(45) Date of Patent: Feb. 25, 2014

(54) CONNECTOR ASSEMBLY AND METHOD OF MANUFACTURING SAME

(75) Inventors: Geoffrey David Bootle, Maidstone (GB); Rodney Dyason, Chatham (GB)

(73) Assignee: Delphi Technologies Holding S.arl (LU)

( * ) Notice: Subject to any disclaimer, the term of this patent is extended or adjusted under 35 U.S.C. 154(b) by 134 days.

(21) Appl. No.: 12/899,199

(22) Filed: Oct. 6, 2010

(65) Prior Publication Data

US 2011/0092092 A1 Apr. 21, 2011

(30) Foreign Application Priority Data

Oct. 15, 2009 (GB) ..... 0918042.3

(51) Int. Cl.
*H01R 24/00* (2011.01)

(52) U.S. Cl.
USPC ..... 439/675; 439/668; 337/299

(58) Field of Classification Search
USPC ..... 439/675, 668; 337/299; 338/28
See application file for complete search history.

(56) References Cited

U.S. PATENT DOCUMENTS

| | | | | |
|---|---|---|---|---|
| 4,128,295 | A | 12/1978 | Bunnell | |
| 4,368,453 | A * | 1/1983 | Herden et al. | 338/25 |
| 4,887,062 | A * | 12/1989 | Bletz | 337/299 |
| 5,199,904 | A | 4/1993 | Wharton | |
| 5,302,934 | A * | 4/1994 | Hart et al. | 338/22 R |
| 5,540,086 | A * | 7/1996 | Park et al. | 73/53.05 |
| 5,720,556 | A * | 2/1998 | Krellner | 374/185 |
| 5,949,324 | A * | 9/1999 | Segler et al. | 338/28 |
| 6,612,875 | B1 | 9/2003 | Liao | |
| 6,837,756 | B2 | 1/2005 | Swearingen et al. | |
| 2003/0068931 | A1 | 4/2003 | Swearingen et al. | |

FOREIGN PATENT DOCUMENTS

| | | |
|---|---|---|
| CN | 101291035 | 10/2008 |
| EP | 0187943 | 7/1986 |
| EP | 0549958 | 7/1993 |
| EP | 0985161 | 8/2003 |
| EP | 1793152 | 6/2007 |
| WO | 96/07094 | 3/1996 |

OTHER PUBLICATIONS

GB Search Report dated Mar. 24, 2010.
China Office Action dated Aug. 2, 2012.

* cited by examiner

*Primary Examiner* — Hien Vu

(57) ABSTRACT

The present invention relates to a connector assembly comprising a connector unit mounted in a housing. The connector unit has a mounting portion, at least one electrical terminal and a body portion having a locking tab. The housing has a first longitudinal axis $X^1$ and the body portion has a second longitudinal axis $X^2$. The first longitudinal axis $X^1$ and the second longitudinal axis $X^2$ are offset from each other to enable the tip of the locking tab to be radially inset. An axial press tool can be used to mount the connector unit mechanically in the housing. The present invention also relates to a method of assembling a connector assembly.

12 Claims, 5 Drawing Sheets

CONNECTOR ASSEMBLY AND METHOD OF MANUFACTURING SAME

TECHNICAL FIELD

The present invention relates to a connector assembly. More particularly, the present invention relates to a connector assembly for a sensor unit. The present invention also relates to a method of manufacturing a connector assembly.

BACKGROUND OF THE INVENTION

It is known to utilize sensors in automotive applications to measure engine characteristics and the like. The sensor is typically provided with a connector assembly to enable the sensor's measurements to be conveyed to an engine management unit, for example. The connector assembly normally comprises a housing and an electrical connector for connection to a matching connector. A locking tab is often provided to ensure that the connectors positively lock together. An oil deterioration sensor having an electrical connector is known from PCT/US95/05204.

There remain various shortcomings of known connector assemblies and the associated methods of manufacture. The present invention, at least in preferred embodiments, attempts to overcome or ameliorate at least some of these problems.

SUMMARY OF THE INVENTION

Viewed from a first aspect, the present invention relates to a connector assembly comprising a connector mounted in a housing; the connector comprising a mounting portion, at least one electrical terminal and a body portion, the body portion having an end piece for mating with a complementary connector; wherein the housing has a first longitudinal axis and the end piece has a second longitudinal axis, said first longitudinal axis and said second longitudinal axis being offset from each other. The housing can optionally further comprise an inwardly directed flange extending over at least a portion of said mounting portion to mount said connector, the end piece being radially inset from or substantially coincident with an innermost radial edge of said flange. Thus, a radially outermost edge of the end piece can be substantially coincident with or inset from an innermost edge of the flange in a radial direction. The end piece is typically offset from the flange in a longitudinal direction.

Thus, the body portion of the connector and the housing are arranged eccentrically. The offset between the first longitudinal axis and the second longitudinal axis creates additional space, for example to accommodate a locking tab.

The connector can be provided with a locking tab. The locking tab can have a tip which is radially inset from, or substantially coincident with an innermost radial edge of said flange. The locking tab can be provided on the body portion of the connector or on the end piece of the body portion. Advantageously, the radial extent of the locking tab in relation to the external profile of the housing can be reduced as a result of the offset arrangement of the body portion and the housing.

Viewed from a further aspect, the present invention relates to a connector assembly comprising a connector mounted in a housing; the connector comprising a mounting portion, at least one electrical terminal and a body portion having a locking tab; wherein the housing has a first longitudinal axis and the body portion has a second longitudinal axis, said first longitudinal axis and said second longitudinal axis being offset from each other.

The connector can be mechanically mounted in the housing. The housing can comprise an inwardly directed flange extending over at least a portion of said mounting portion to mount said connector. The flange can be swaged, or otherwise deformed, over said mounting portion to secure the connector in position. The flange may extend around the circumference of the mounting portion. It will be appreciated that more than one flange could be provided.

The flange can be formed integrally with said housing. Initially, the flange can extend substantially parallel to said first longitudinal axis. The connector is then seated in the housing and the flange can be formed by the axial application of a cylindrical swaging press tool. The flange is deformed by the press tool so as to extend inwardly towards said first longitudinal axis and may abut a front face of the mounting portion of the connector thereby retaining it in position. Advantageously, the offset between the first longitudinal axis and the second longitudinal axis means that the press tool can be applied axially without fouling the end piece or the locking tab.

The locking tab may extend radially from said second longitudinal axis. The locking tab has a tip which can be radially inset from or is substantially coincident with (in a radial direction) an innermost radial edge of said flange. This arrangement is desirable since it ensures that adequate space is provided for the press tool to swage the flange during the assembly of the electrical connector. It will be appreciated that the locking tab is usually displaced from the flange in an axial direction.

The second longitudinal axis can be coincident with a central longitudinal axis of the end piece. The second longitudinal axis can be offset from the first longitudinal axis in a first direction and the locking tab may extend in a second direction. The first direction and the second direction can be opposite to each other. The locking tab can extend radially along a transverse axis bisecting both said first longitudinal axis and said second longitudinal axis.

At least in preferred embodiments, the first longitudinal axis and the second longitudinal axis are substantially parallel to each other. The first longitudinal axis and the second longitudinal axis can be offset from each other by between 0.5 mm and 7.5 mm; 1 mm and 5 mm; or 1 mm and 3 mm. However, it will be appreciated that the present invention can be applied to any scale of electrical connector or device in which similar construction issues are encountered.

The mounting portion of the connector can have a third longitudinal axis which is offset from said second longitudinal axis. The third longitudinal axis can be substantially coincident with the first longitudinal axis.

The portion of said housing for receiving the connector can be defined by or comprise a first cylindrical portion. The first longitudinal axis can be coincident with the central longitudinal axis of the first cylindrical portion of the housing. The first cylindrical portion can be a first right circular cylinder. The housing can be threaded to facilitate mounting of the electrical connector. The threaded portion of the housing has a longitudinal thread axis which can be substantially coincident with the first longitudinal axis. The housing can be provided with a series of flat surfaces for receiving a spanner or socket. The housing can have a hexagonal set.

The body portion of the connector could have a polygonal cross-section, for example in the form of a rectangle or square. In particular, the end piece could have a polygonal transverse cross section. Alternatively, the body portion and/or the end piece can have a circular cross-section. The body portion and/or the end piece of the connector can be defined by or comprise a second cylindrical portion. The second longitudinal axis can be coincident with the central longitudinal axis of the second cylindrical portion. The second cylindrical portion can be a second right circular cylinder.

The end piece can form a male connector locatable in a receiving portion of a complementary female connector. Alternatively, the end piece can form a female connector having a receiving portion for receiving a complementary male connector.

The mounting portion of the connector can be defined by or comprise a third cylindrical portion. The third longitudinal axis can be coincident with the longitudinal axis of the third cylindrical portion. The third cylindrical portion can be a third right circular cylinder.

The housing can be formed of metal, such as aluminium. The connector can be formed from a plastics material or other suitable insulating material. The locking tab could be formed integrally with the connector.

The at least one electrical terminal can extend substantially parallel to said first longitudinal axis. This arrangement allows the electrical connector to be connected to a mating connector by an axial movement.

Viewed from a further aspect, the present invention relates to a connector assembly comprising a housing and a connector; the connector comprising a mounting portion, at least one electrical terminal and a body portion having a locking tab; wherein the housing and the body portion are arranged eccentrically.

Viewed from a still further aspect, the present invention relates to a connector assembly comprising a housing and a connector; the connector comprising a mounting portion, at least one electrical terminal and a body portion having an end piece for mating with a complementary connector; wherein the housing and the end piece are arranged eccentrically. The housing can optionally further comprise an inwardly directed flange extending over at least a portion of said mounting portion to mount said connector. The end piece can be radially inset from or substantially coincident with an innermost radial edge of said flange. Thus, a radially outermost edge of the end piece can be coincident with or inset from an innermost edge of the flange in a radial direction. The end piece is typically offset from the flange in a longitudinal direction.

The end piece can have a locking tab having a tip which is radially inset from, or substantially coincident with an innermost radial edge of said flange.

The present invention also relates to a complementary connector for connecting to the connector assembly as described herein. The complementary connector can comprise a second housing and a second connector. The second connector can comprise a second body portion for cooperating with the connector of the sensor unit. The second housing has a first longitudinal axis and the second body portion has a second longitudinal axis, said first longitudinal axis and said second longitudinal axis being offset from each other.

When the connector assembly of the present invention is connected to the complementary connector, an external profile of the first housing can substantially matches that of the second housing. Advantageously, by aligning the external profiles of the first and second housings, the correct alignment of the first and second connectors is achieved. A visual inspection can also establish that the sensor unit and the complementary connector are correctly aligned.

The connector assembly according to the present invention can be suitable for use in an automotive application. The present invention also relates to a sensor unit or an actuator unit comprising a connector assembly as described herein. For example, a solenoid can be provided with the connector assembly according to the present invention. Alternatively, an engine control unit (ECU) could be provided with one or more connector assemblies as described herein.

Viewed from a still further aspect, the present invention relates to a connector comprising a mounting portion and a body portion having a locking tab; wherein the body portion has a first longitudinal axis and the mounting portion has a second longitudinal axis, said first longitudinal axis and said second longitudinal axis being offset from each other. The connector can be of the type described herein as forming part of a connector assembly. The connector can be suitable for mounting in a housing.

The connector could be used in a variety of applications, for example to provide a fibre optic connection. However, the connector can comprise at least one electrical terminal. The at least one electrical terminal can be provided in the body portion of the connector.

The connector could be provided mounted in a housing or casing.

The present invention also relates to a complementary connector for connecting to a connector of this type. The complementary connector can have a second body portion for cooperating with the body portion of the connector. The second body portion can be offset axially to match the body portion of the connector.

Viewed from a yet still further aspect, the present invention relates to a method of assembling a connector assembly, the connector assembly comprising a housing and a connector; the connector having a mounting portion and a body portion. The body portion can have a locking tab; wherein the body portion has a first longitudinal axis and the mounting portion has a second longitudinal axis, said first longitudinal axis and said second longitudinal axis being offset from each other. Alternatively, the body portion can have an end piece for mating with a complementary connector; wherein the end piece has a first longitudinal axis and the mounting portion has a second longitudinal axis, said first longitudinal axis and said second longitudinal axis being offset from each other. The method comprises the steps of: locating the mounting portion of the connector in the housing; axially applying a swaging press tool to swage a flange of the housing against a surface of the mounting portion to mount the connector; and withdrawing the swaging press tool. The connector is preferably of the type described herein wherein the body portion and the mounting portion of the connector are axially offset from each other. This offset provides sufficient space for the swaging press tool to be engaged without interfering with the locking tab. The connector preferably comprises at least one electrical terminal.

The flange can be swaged around the complete circumference of the mounting portion of the connector. The swaging press tool can extend around the circumference of the connector. The swaging press tool can extend at least to the radially innermost edge of the flange. By applying a pressure over the entire surface of the flange, a uniform flange profile can be obtained.

Viewed from a still further aspect, the present invention relates to an electrical connector comprising a connector mounted in a housing; the connector comprising a mounting portion, at least one electrical terminal and a body portion having a locking tab; wherein the housing has a first longitudinal axis and the body portion has a second longitudinal axis, said first longitudinal axis and said second longitudinal axis being offset from each other.

BRIEF DESCRIPTION OF THE DRAWINGS

A preferred embodiment of the present invention will now be described, by way of example only, with reference to the accompanying figures, in which.

DESCRIPTION OF THE PREFERRED EMBODIMENT

Figure 1:
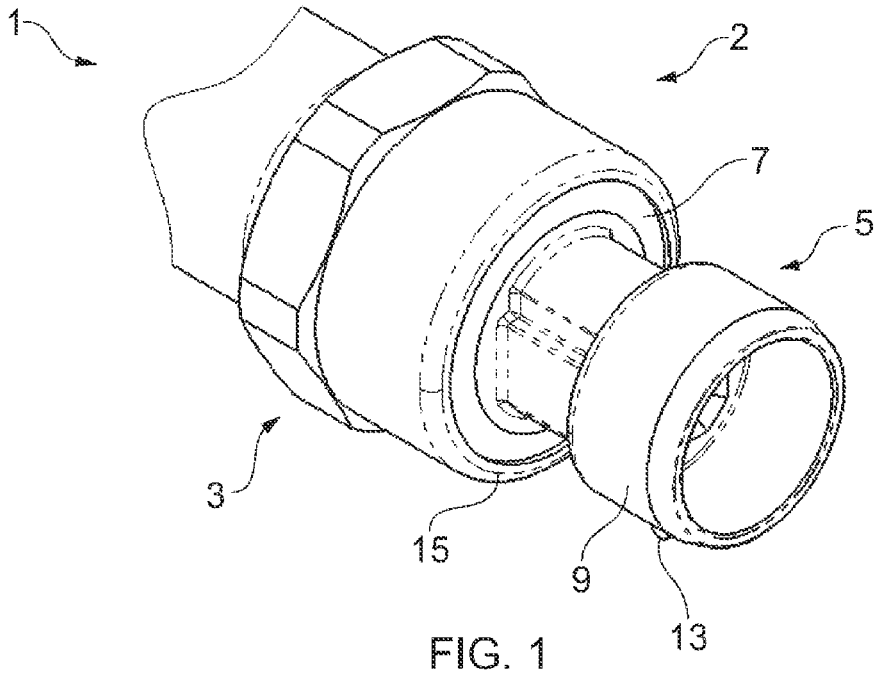
FIG. 1 PRIOR ART
FIG. 1 shows an isometric view of a sensor unit having an electrical connector.
Figure 2:
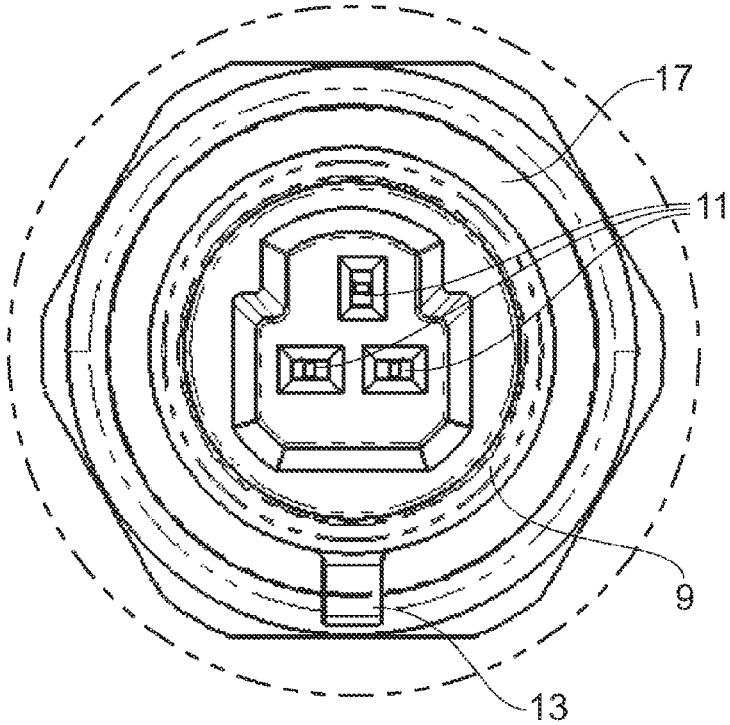
FIG. 2 PRIOR ART
FIG. 2 shows an end view of the sensor unit of FIG. 1 and a swaging press tool during the assembly process.
Figure 3:
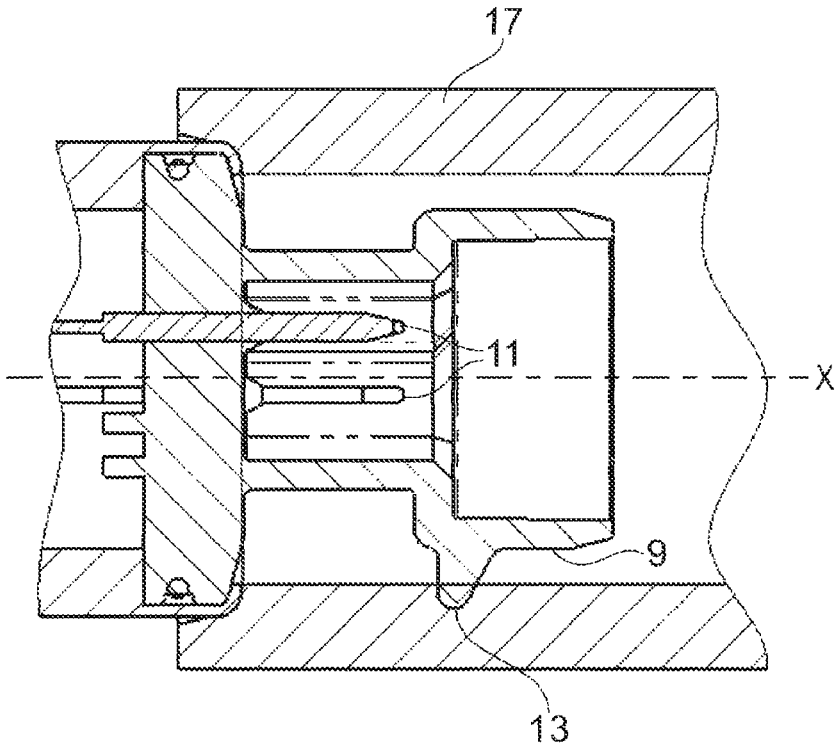
FIG. 3 PRIOR ART
FIG. 3 shows a cross-sectional view of the sensor unit of FIG. 1 and the swaging press tool during the assembly process.

A sensor unit 1 for an automotive application is illustrated in FIGS. 1 to 3 to assist in the understanding of the present invention. The sensor unit 1 is not representative of the present invention but instead is provided to identify the problem recognised by the inventor in the present case.

The sensor unit 1 is provided with an electrical connector assembly 2 for connecting the sensor unit 1 to a processing unit (not shown). The connector assembly 2 comprises a metal housing 3 and a connector 5. The housing 3 has an external thread (not shown) and a hexagonal set for receiving a spanner or wrench to mount the sensor unit 1. The connector 5 comprises a base mounting portion 7; a body portion 9 housing one or more electrical terminals 11; and a locking tab 13. The mounting portion 7 and the body portion 9 are generally cylindrical and have a common longitudinal axis X. In use, the locking tab 13 locates in a complementary recess provided in a mating connector to lock the connector 5 in position.

The connector 5 is mechanically secured within the housing 3 by a flange 15. The mounting portion 7 of the connector 5 is located in the housing 3 and the flange 15 deflected radially inwardly so as to abut a front face of the mounting portion 7. The preferred technique for deflecting the flange 15 would be to apply a swaging press tool 17 in an axial direction along the common longitudinal axis X to swage the flange 15 to the desired position. However, if a connector 5 of the type shown is employed, it is not possible to apply a press tool axially since its movement would be obstructed by the locking tab 13.

As shown in FIGS. 2 and 3, the locking tab 13 projects radially outwardly beyond the radially innermost end of the flange 15. If the swaging press tool 17 was advanced in an axial direction along the common longitudinal axis X, from right to left in the view shown in FIG. 3, it would contact the tip of the locking tab 13. This would obstruct the movement of the swaging press tool 17 and/or damage the locking tab 13. Although it may be possible in certain applications to increase the diameter of the housing 3, this is not always practicable, for example due to limitations in the available space in the intended application for the sensor unit 1.

Alternate techniques for forming the flange 15, such as rolling or press forming the flange in a transverse direction, are required to allow the flange to be formed without interfering with the locking tab. However, these approaches would likely increase the cost and/or complexity of the manufacturing of the sensor unit 1.

Figure 4:
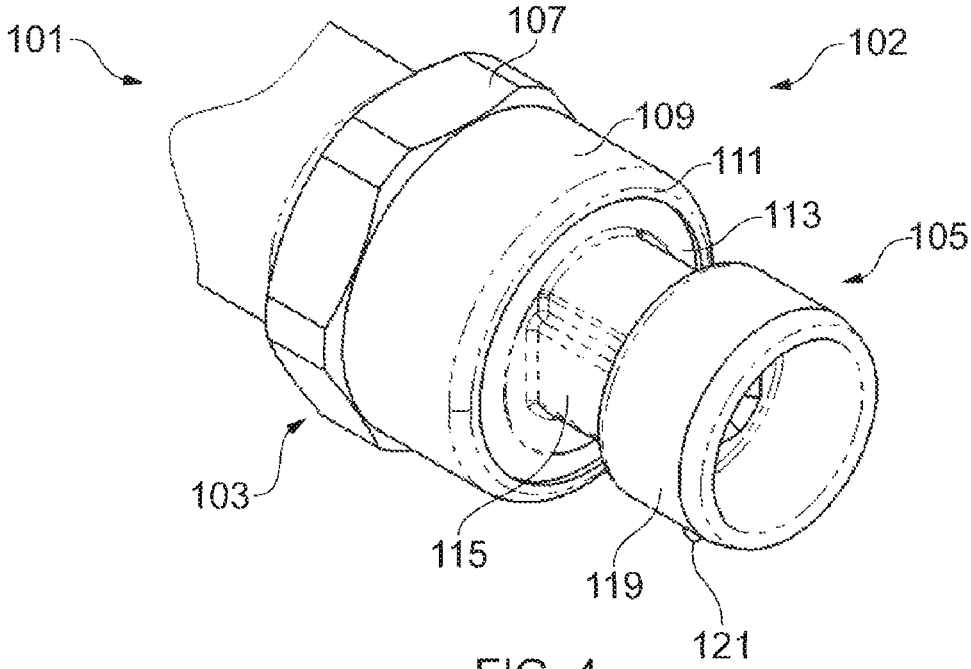
FIG. 4 shows an isometric view of a sensor unit having an electrical connector according to a preferred embodiment of the present invention.
Figure 5:
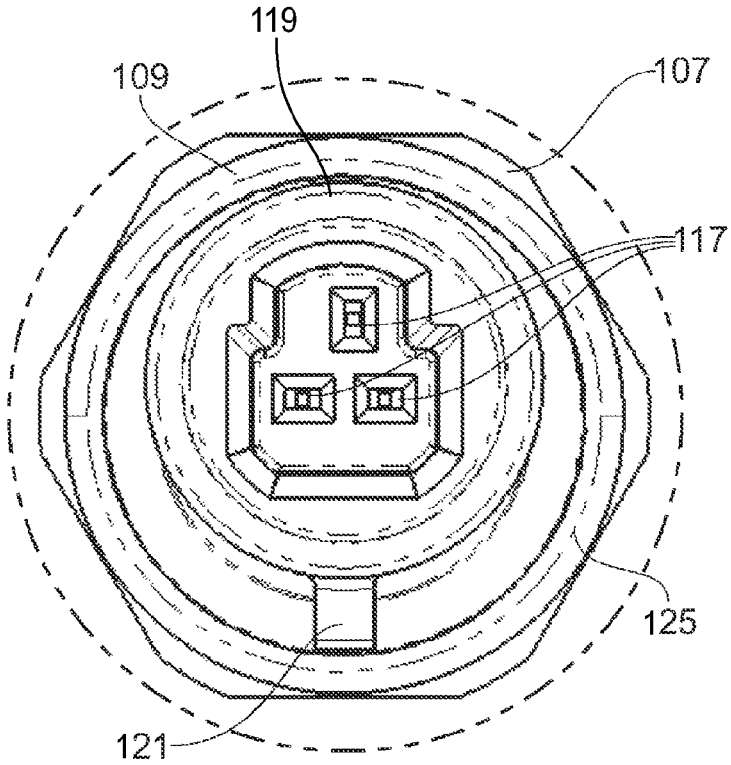
FIG. 5 shows an end view of the sensor unit of FIG. 4 and a swaging press tool during the assembly process.
Figure 6:
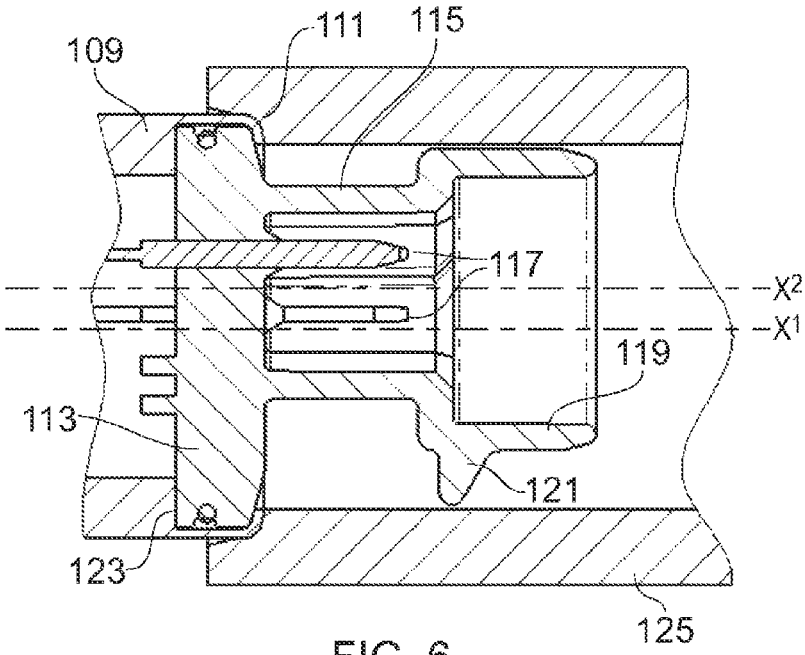
FIG. 6 shows a cross-sectional view of the sensor unit of FIG. 4 and the swaging press tool during the assembly process.

A sensor unit 101 according to a preferred embodiment of the present invention will now be described with reference to FIGS. 4 to 6. The sensor unit 101 according to the present embodiment is to be used for an engine load sensor in an internal combustion engine. In particular, the sensor unit 101 is to be mounted on a pump unit. It will be appreciated that the present invention is not limited to this application and the sensor unit can incorporate one or more sensors for measuring a range of characteristics.

The sensor unit 101 comprises a sensor (not shown), and a connector assembly 102 for connecting the sensor unit 101 to a processing unit (not shown), for example provided in an engine management or control unit. The connector assembly 102 comprises a housing 103 and an electrical connector 105. The housing 103 is formed from aluminium and has an external thread (not shown) and a hexagonal set 107 for receiving a spanner or wrench to mount the sensor unit 101. In the present embodiment, the hexagonal set 107 is intended to receive a 24 mm AF Hex socket.

The housing 103 has a cylindrical sleeve 109 having rotational symmetry about a first longitudinal axis $X^1$. The thread on the housing 103 has a longitudinal thread axis which is co-axial with the first longitudinal axis $X^1$. A flange 111 is provided at a first end of the sleeve 109 distal from the hexagonal set 107. As described in greater detail below, the flange 111 extends radially inwardly and mechanically mounts the connector 105 in the sensor unit 101. The sensor is typically provided within the housing 103 at or proximal to the opposite end to which the connector assembly 102 is provided.

The connector 105 comprises a circular mounting portion 113 and a body portion 115. The body portion 115 is moulded from a plastics material and houses three electrical terminals 117. The body portion 115 is generally cylindrical about a longitudinal axis of symmetry of the body portion. The free end of the body portion 115 has an enlarged diameter and defines an end piece in the form of a guide cylinder 119 for receiving a mating connector. The guide cylinder 119 has rotational symmetry about a second longitudinal axis $X^2$. In the present embodiment, the second longitudinal axis $X^2$ is coincident with the longitudinal axis of symmetry of the body portion 115. It will, however, be appreciated that the end piece could be offset from the remainder of the body portion.

A locking tab 121 is formed integrally on the exterior of the guide cylinder 119 of the body portion 115. The electrical terminals 117 are fixedly mounted in the body portion 115 using known techniques. The locking tab 121 extends radially from said second longitudinal axis $X^2$. The locking tab 121 could in certain embodiments be omitted.

The first and second longitudinal axes $X^1$ and $X^2$ are offset from each other by 1.5 mm and extend parallel to each other. Thus, the mounting portion 113 and the guide cylinder 119 of the connector 105 are eccentric. The second longitudinal axis $X^2$ is offset from the first longitudinal axis $X^1$ in a first direction and the locking tab 121 extends in a second direction substantially opposite to said first direction. In other words, the locking tab extends along a transverse axis bisecting both said first longitudinal axis $X^1$ and said longitudinal second axis $X^2$. This arrangement is advantageous since the offset of the body portion 115 creates additional space for the locking tab 121 allowing the tip of the locking tab 121 to be inset radially from (or substantially coincident with) an innermost radial edge of the flange 111.

Figure 9:
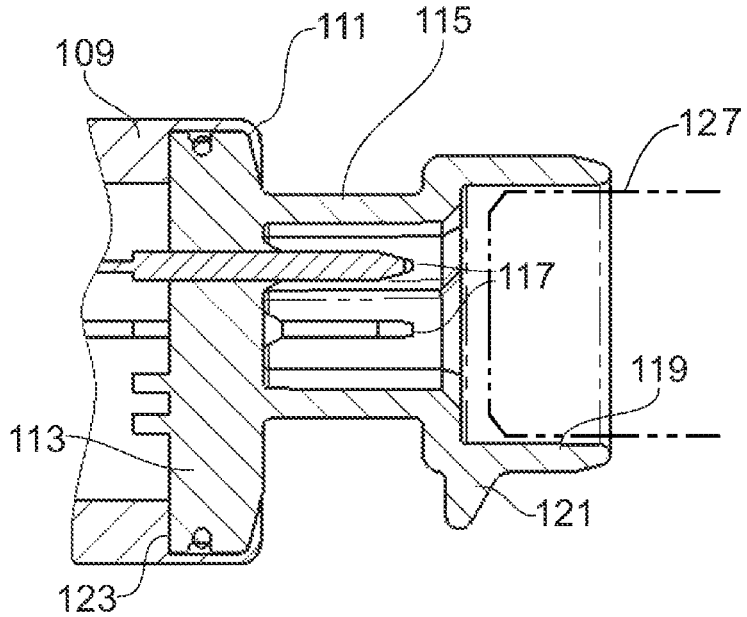
FIG. 9 shows a cross-sectional view of the sensor unit of FIG. 4 with a representation of a mating male connector.
Figure 10:
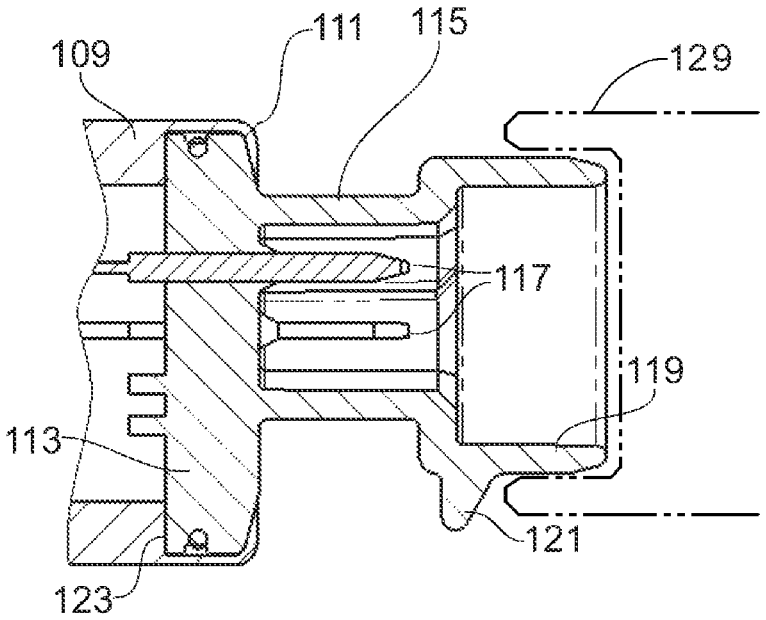
FIG. 10 shows a cross-sectional view of the sensor unit of FIG. 4 with a representation of a mating female connector.

In use, the body portion 115 can connect with a mating connector in conventional manner. As shown in FIG. 9, the end piece 119 can form a female connector having a receiving portion for receiving a complementary male connector 127. Alternatively, the end piece 119 can form a male connector portion locatable in a receiving portion of a complementary female connector 129, as shown in FIG. 10. The locking tab 121 engages in a recess provided in the mating connector to lock the connectors together. The locking tab 121 can be profiled to ensure that the body portion 115 and the mating connector are permanently locked together, or it may serve to provide a temporary lock which allows the body portion 115 to be disconnected from the mating connector. The sensor unit 101 according to the present invention is intended for mounting on a pump (not shown) via the external thread provided on the housing. The operation of the sensor unit 101 in accordance with the present invention is conventional.

The assembly of the sensor unit 101 and in particular the connector assembly 102 according to the present invention will now be described with particular reference to FIGS. 5 and 6.

The flange 111 of the housing 103 initially extends in an axial direction. The connector 105 is located in the housing 103 such that the mounting portion 113 locates on a mounting seat 123 formed on an inside wall of the sleeve 109. A cylindrical swaging press tool 125 of conventional design is then advanced along the first longitudinal axis $X^1$ in an axial direction to swage the flange 111 such that it extends radially inwardly over a front face of the mounting portion 113. The press tool 125 presses against the flange 111 such that it abuts the front face of the mounting portion 113 and mechanically retains the connector 105 in position. The press tool 125 is retracted in an axial direction once the flange 111 has been formed.

Since the first longitudinal axis $X^1$ and the second longitudinal axis $X^2$ are offset from each other, the guide cylinder 119 and the tip of the locking tab 121 are inset from the innermost radial edge of the flange 111. As shown in FIGS. 5 and 6, both the body portion 115 and the locking tab 121 are received within the body of the press tool 125 as it is advanced and retracted during the swaging process. Thus, the press tool 125 can follow an axial path along the first longitudinal axis $X^1$ without interfering with the locking tab 121.

Figure 7:
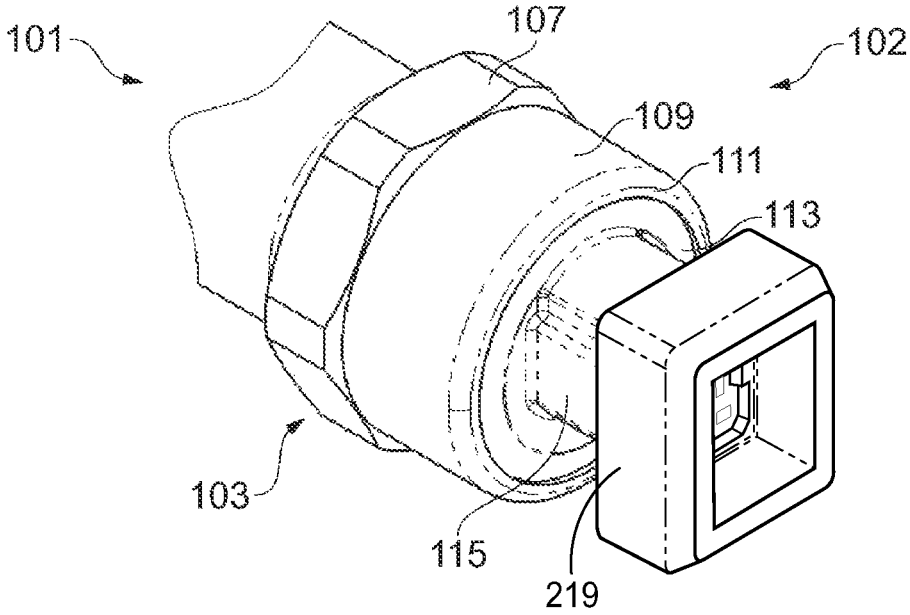
FIG. 7 shows an isometric view of a sensor unit having an electrical connector according to an alternative embodiment of the present invention.
Figure 8:
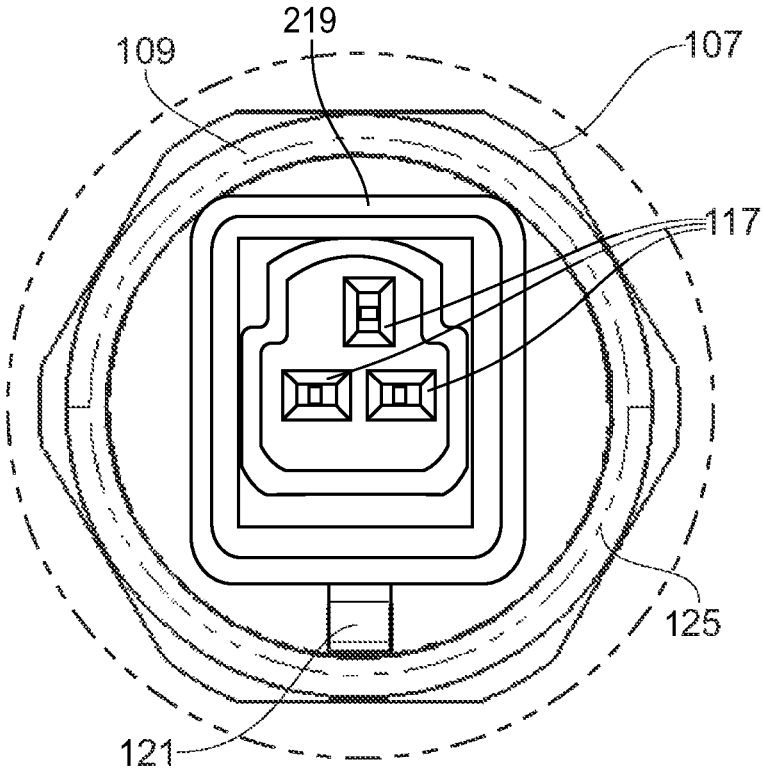
FIG. 8 shows an end view of the sensor unit of FIG. 7 and a swaging press tool during the assembly process.

FIG. 7 and FIG. 8 depict an embodiment of the invention in which the end piece 219 comprises a polygonal transverse cross section, more particularly a rectangular transverse cross section.

The other steps in the assembly of the sensor unit 101 are conventional and are omitted from the description herein for the sake of brevity.

It will be appreciated that various changes and modifications can be made to the electrical connector and the method of manufacturing same, as described herein, without departing from the scope of the present invention.

The invention claimed is:

1. A connector assembly comprising a connector mounted in a housing; the connector comprising a circular mounting portion having an upper side and a lower side, at least one electrical terminal and a body portion, the body portion having an end piece positioned close to the upper side than the lower side of the circular mounting portion to mate with a complementary connector; wherein the mounting portion has rotational symmetry about a first longitudinal axis and the end piece has rotational symmetry about a second longitudinal axis, said first longitudinal axis and said second longitudinal axis being offset from each other; wherein said housing comprises an inwardly directed flange extending over at least a portion of said mounting portion to mount said connector, the end piece being radially inset from or substantially coincident with an innermost radial edge of said flange;

wherein a locking tab extends outwardly from a lower side of said end piece, said locking tab having a tip which is radially inset from, or substantially coincident with an innermost radial edge of said flange.

2. A connector assembly as claimed in claim 1, wherein said second longitudinal axis is offset from the first longitudinal axis in a first direction and said locking tab extends in a second direction.

3. A connector assembly as claimed in claim 1, wherein said locking tab extends radially along a transverse axis bisecting both said first longitudinal axis and said longitudinal second axis.

4. A connector assembly as claimed in claim 1, wherein said first longitudinal axis and said second longitudinal axis are substantially parallel to each other.

5. A connector assembly as claimed in claim 1, wherein the end piece comprises a circular or polygonal transverse cross section.

6. A connector assembly as claimed in claim 1, wherein the end piece forms a male connector locatable in a receiving portion of a complementary female connector.

7. A connector assembly as claimed in claim 1, wherein the end piece forms a female connector having a receiving portion for receiving a complementary male connector.

8. A sensor unit or an actuator unit comprising a connector assembly as claimed in claim 1.

9. A connector assembly comprising a housing and a connector; the connector comprising a circular mounting portion having an upper side and a lower side, at least one electrical terminal and a body portion having an end piece positioned close to the upper side than the lower side of the circular mounting portion for mating with a complementary connector; wherein the housing and the end piece are arranged eccentrically; the housing comprising an inwardly directed flange extending over at least a portion of said mounting portion to mount said connector; wherein the end piece has a locking tab extends outwardly from a lower side of said end piece, said locking tab having a tip which is radially inset from or substantially coincident with an innermost radial edge of said flange.

10. A connector assembly as claimed in claim 9, wherein the end piece comprises a circular or polygonal transverse cross section.

11. A connector assembly as claimed in claim 9, wherein the end piece forms a male connector locatable in a receiving portion of a complementary female connector.

12. A connector assembly as claimed in claim 9, wherein the end piece forms a female connector having a receiving portion for receiving a complementary male connector.

* * * * *